US006152207A

United States Patent [19]

Varley

[11] Patent Number: 6,152,207

[45] Date of Patent: Nov. 28, 2000

[54] TANDEM WINDBAR SYSTEM FOR ROLLUP DOOR

[75] Inventor: David A. Varley, Lewistown, Pa.

[73] Assignee: Overhead Door Corporation

[21] Appl. No.: 09/335,013

[22] Filed: Jun. 17, 1999

[51] Int. Cl.[7] ..... A47G 5/02

[52] U.S. Cl. ..... 160/264; 160/84.01; 160/265; 160/271

[58] Field of Search ..... 160/264, 265, 160/84.1, 133, 266, 274, 275, 271, 23.1, 310, 267.1, 270, 268.1

[56] References Cited

U.S. PATENT DOCUMENTS

| | | | |
|---|---|---|---|
| 4,800,946 | 1/1989 | Rosenoy . | |
| 4,889,176 | 12/1989 | Nilsson . | |
| 4,896,714 | 1/1990 | Ellis | 160/264 X |
| 4,934,437 | 6/1990 | Kraeutler . | |
| 5,056,579 | 10/1991 | Krafutler . | |
| 5,141,043 | 8/1992 | Kraeutler . | |
| 5,199,479 | 4/1993 | Kraeutler | 160/264 X |
| 5,219,015 | 6/1993 | Kraeutler . | |
| 5,323,831 | 6/1994 | Manthei . | |
| 5,601,134 | 2/1997 | Pinkalla et al. . | |
| 5,632,317 | 5/1997 | Krupke et al. . | |
| 5,862,850 | 1/1999 | Yang | 160/264 X |
| 5,988,254 | 11/1999 | Hanright | 160/264 X |

*Primary Examiner*—Bruce A. Lev
*Attorney, Agent, or Firm*—Akin, Gump, Strauss, Hauer & Feld, LLP

[57] ABSTRACT

A tandem windbar system for a flexible curtain rollup door includes a first windbar adapted to be guided in opposed guide channels of a door assembly and supported by flexible strap members which are secured at one end to a rotatable drum for rolling a flexible curtain closure member onto and off of the drum to open and close the door. Opposite ends of the strap members are secured to stationary structure, such as the upper ends of opposed guide channels for the door curtain and the first windbar. A second windbar is supported below the first windbar by opposed flexible straps which are operably connected at one end to the first windbar by a bearing tube member which may rotate relative to and is supported on the first windbar. The straps of the second set are trained around and support the second windbar and are connected at their opposite ends to the curtain drum for rolling onto and off of the drum. The second windbar ascends and descends at 1.50 times the speed of the first windbar during opening and closing movements of the door curtain to position the second windbar midway between the first windbar and the lower edge of the door curtain in the closed position. The second windbar is also positioned directly adjacent the first windbar in an open position of the door and directly below the curtain support drum.

20 Claims, 4 Drawing Sheets

TANDEM WINDBAR SYSTEM FOR ROLLUP DOOR

FIELD OF THE INVENTION

The present invention pertains to a tandem windbar system for a rollup door wherein two spaced apart windbars are extensible to a working position and retractable to a non-working position in concert with movement of the door curtain.

BACKGROUND

Flexible curtain rollup doors are used in many applications as exterior doors as well as in applications as interior doors between rooms wherein air pressure differentials may develop across the door. In this regard, it is known to provide flexible curtain or so-called rollup doors with moveable, transversely extending, and substantially rigid windbar members in both exterior and interior applications to minimize deflection of the door curtain under air pressure differential forces or so-called windloads. By way of example, the U.S. Pat. No. 5,632,317 issued May 27, 1997 to LeRoy G. Krupke et al. and assigned to the assignee of the present invention, includes description and claims directed to a moveable windbar for a rollup flexible curtain type door, which windbar is supported by opposed straps which are trained over drum members which rotate with the flexible curtain support drum. The windbar support straps are arranged such that the windbar retracts to a position directly under the door curtain in its rolled up condition when the door is open and the windbar extends or descends into a position approximately midway between the door curtain roller or drum and the door bottom edge in the closed position, thanks to a 2:1 reduction ratio in the overall movement of the windbar between open and closed positions.

However, in many applications of flexible curtain or similar rollup doors, a single windbar is not sufficient to prevent deflection of the door curtain to the extent which may cause the curtain to pull out of opposed side guide members. In this respect, at least one additional windbar disposed between the first mentioned windbar and the door bottom edge would be advantageous to minimize curtain pullout from the door side guides or unwanted release of the door bottom edge member in the event that the windload forces acting on the curtain became substantial. Accordingly, there has been a significant need for a windbar system for flexible curtain and similar so-called rollup type doors wherein at least two windbars are provided spaced apart between the door curtain drum and the door bottom bar when the curtain is in the closed position and which windbars are retractable out of the way to provide a suitable door opening when the flexible curtain is raised. It is to these ends that the present invention has been developed.

SUMMARY OF THE INVENTION

The present invention provides a windbar system for a flexible curtain rollup type door wherein at least two windbars are extensible and retractable in concert with movement of the door curtain between closed and opened positions.

In accordance with one important aspect of the present invention, a flexible curtain rollup type door is provided with a tandem windbar system including two laterally extending and vertically moveable windbars which, in the closed position of the door curtain, are spaced apart from each other a predetermined distance. A preferred spacing of the windbars is placement of one windbar in a position approximately midway between the door curtain drum or roller and the door bottom edge member. The second windbar is adapted to be positioned approximately midway between the first windbar and the door bottom edge member or so-called bottom bar. The first windbar is moveable between extended and retracted positions by a set of opposed straps, which may be formed as a single continuous strap member, connected at one end to stationary structure, such as the door side guide members and the opposite end of the strap or straps is secured for rotation with the door curtain roller or drum. In this way the first windbar may be positioned approximately midway between the door curtain drum and the bottom edge of the door in its closed position and then retracted to an out-of-the-way non-working position directly adjacent the curtain drum when the curtain is rolled substantially thereon to the door open position.

The second windbar is also advantageously mounted for movement to a working position approximately midway between the first windbar and the door bottom edge, again in the door closed position. The second windbar is also moveable by a set of straps which are attached at one end, respectively, to the door curtain roller or drum, are trained around the second windbar and are attached at their opposite ends to a sleeve which is supported on the first windbar. In this way, the second windbar moves when the door curtain drum is rotated at a speed 1.50 times the speed of the first windbar and at 0.75 times the speed of the door bottom bar. This relationship results in the second windbar reaching a storage position directly below the first windbar when the door curtain reaches its fully open position.

The present invention still further provides a tandem windbar system which may be arranged to resist deflection and pullout of a flexible door curtain on either or both sides of the door curtain to accommodate air pressure differential or so-called windloads which might be imposed on both sides of a door curtain.

Those skilled in the art will further appreciate the above-mentioned advantages and superior features of the invention together with other important aspects thereof upon reading the detailed description which follows in conjunction with the drawing.

DETAILED DESCRIPTION OF PREFERRED EMBODIMENTS

Figure 1:
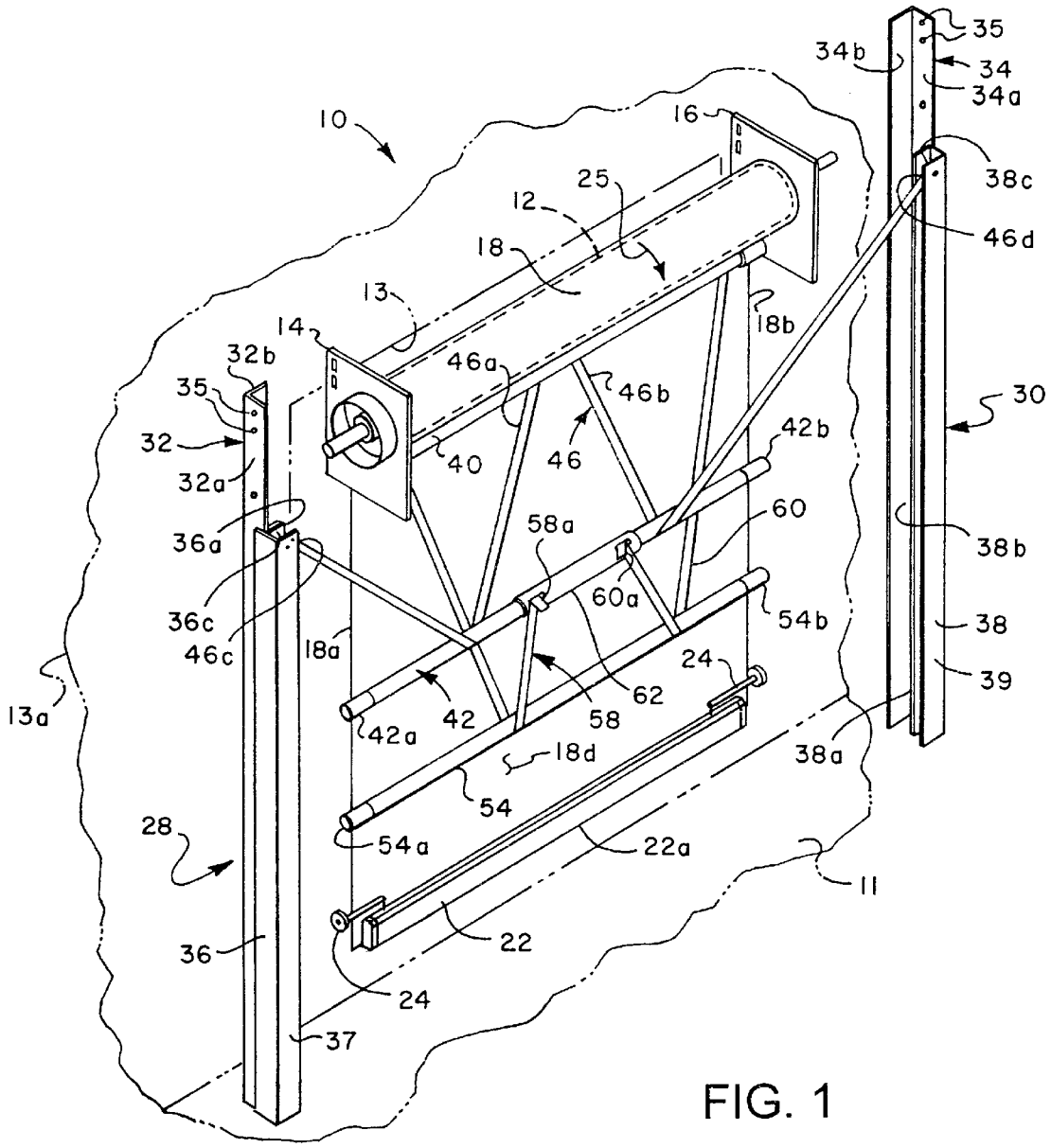
FIG. 1 is an exploded perspective view of a flexible curtain rollup door assembly including a tandem windbar system in accordance with one preferred embodiment of the invention.

In the description which follows like parts are marked throughout the specification and drawing with the same reference numerals, respectively. The drawing figures are not necessarily to scale and certain features may be shown in exaggerated or in generalized form in the interest of clarity and conciseness.

Referring to FIG. 1, there is illustrated a flexible curtain type rollup door assembly, generally designated by the numeral 10, including a generally cylindrical curtain winding drum 12 adapted to be supported for rotation on opposed headplates 14 and 16 and having wound thereon a flexible curtain door closure member 18. The closure member 18 is delimited by a lower transverse edge which includes a so-called bottom bar 22, including opposed guide members 24 extending laterally therefrom. The flexible curtain closure member 18 is adapted to be rolled onto the drum 12 in the direction of arrow 25 to "open" the door 10 with respect to a generally rectangular opening 13 in a vertical wall 13*a,* FIG. 1. The door assembly 10 also includes opposed side edge guide assemblies 28 and 30 comprising mirror images of each other and characterized by elongated angle members 32 and 34, respectively. Flanges 32*a* and 34*a* of the respective angle members 32 and 34 are provided with suitable fastener receiving holes 35, as shown, for attaching the headplates 14 and 16 to the respective guide assemblies 28 and 30.

Figure 1A:
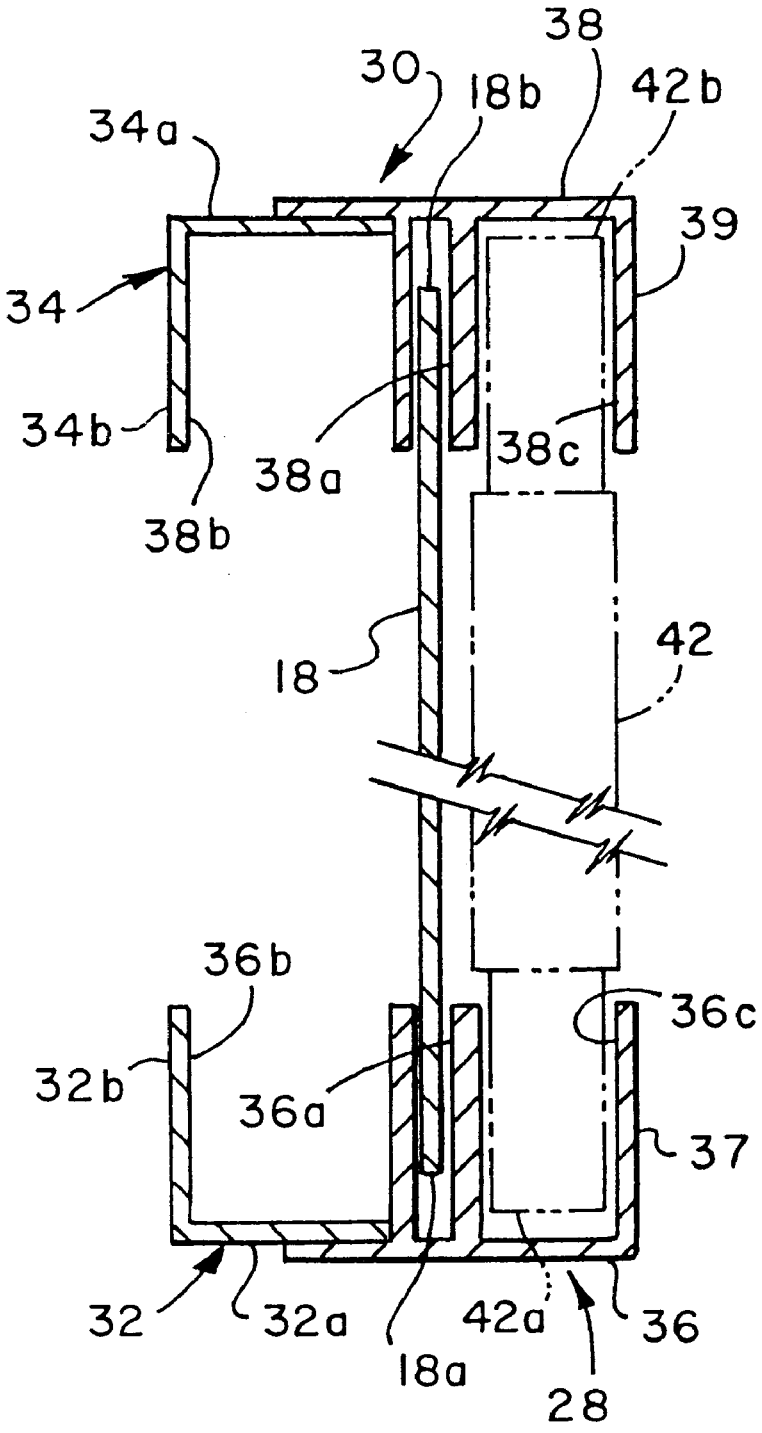
FIG. 1A is a detail section view showing the configuration of opposed door guide assemblies.

Referring to FIGS. 1 and 1A, the guide assemblies 28 and 30 are also characterized by elongated guide members 36 and 38 which are suitably secured to the angle members 32 and 34, respectively, and are adapted to receive the opposed curtain side edges 18*a* and 18*b* for sliding movement within respective slots 36*a* and 38*a* formed therein. The specific configuration of the guide members 36 and 38 may be like that shown in U.S. Pat. No. 5,632,317. Somewhat channel shaped elongated spaces 36*b* and 38*b* are formed between the guide members 36 and 38 and the respective flanges 32*b* and 34*b* of angle members 32 and 34. Members 36 and 38 also include, respectively, flanges 37 and 39 to provide channel spaces 36*c* and 38*c* extending parallel to slots 36*a* and 38*a* and channel spaces 36*b* and 38*b,* respectively.

An elongated curtain guide bar 40 extends between the headplates 14 and 16 and is suitably secured thereto. The guide bar 40 is placed closely adjacent to the drum 12 while allowing clearance between the guide bar and the curtain closure member 18 when it is fully rolled onto the drum. However, the guide bar 40 serves to guide and minimize wrinkling or bunching of the curtain closure member 18 as it is rolled onto and off of the drum 12.

Referring further to FIG. 1, the door assembly 10 includes a first, elongated, generally cylindrical tubular windbar 42, the opposite ends 42*a* and 42*b* of which are adapted to be disposed in the vertically extending channel shaped spaces 36*c* and 38*c,* respectively, as shown in FIG. 1A, for guiding the windbar for movement generally vertically along the guide assemblies 28 and 30 between a retracted position wherein the windbar 42 is disposed just below the drum 12 and guide bar 40 and an extended position, generally as shown in FIG. 1. In the embodiment of FIG. 1, the guide members 24 also extend within channel spaces 36*c* and 38*c*.

Figure 7:
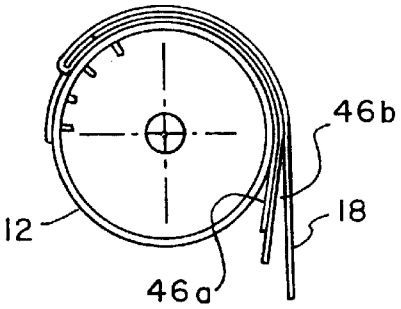
FIG. 7 is a detail section view taken from the line 7—7 of FIG. 6.
Figure 6:
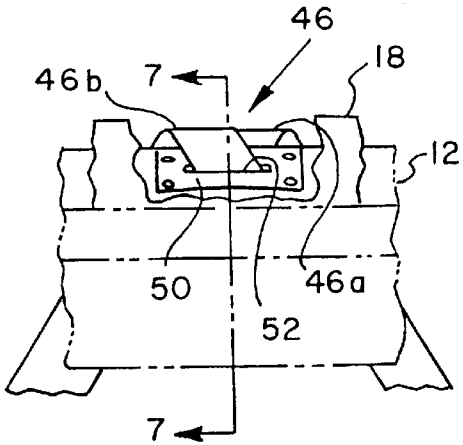
FIG. 6 is a detail elevation view showing one preferred arrangement for attaching the support strap for the upper windbar to the curtain drum.

The windbar 42 is moved between its retracted and extended positions by gravitational forces and by a flexible windbar raising strap assembly 46 comprising opposed strap members 46*a* and 46*b*. Strap 46*a* is secured to the drum 12 in a manner preferably as shown in FIGS. 6 and 7 wherein curtain closure member 18 is shown broken away, and strap assembly 46 is shown trained through a support bracket 50 having an elongated slot 52 formed therein and being suitably secured to the surface of the drum 12 by conventional fasteners. Accordingly, a single continuous strap 46 may be used to form the strap members 46*a* and 46*b*. Alternatively, separate strap members 46*a* and 46*b* may be suitably secured at one end, respectively to the drum 12.

Referring again to FIG. 1, the strap members 46*a* and 46*b* extend downwardly from drum 12 in a somewhat inverted "V arrangement while lying closely adjacent the surface of curtain closure member inner face 18*d*. Strap members 46*a* and 46*b* are trained under the windbar 42 in supportive relationship thereto and the distal ends of the strap members 46*a* and 46*b,* indicated at 46*c* and 46*d,* respectively, are preferably secured to the guide member flanges 37 and 39 using conventional fasteners or the like.

Accordingly, the strap 46, comprising the strap members 46*a* and 46*b,* is adapted to be rolled onto the drum 12 when the curtain closure member 18 is being rolled onto the drum, since the portions of these members which are disposed between the windbar 42 and the drum 12 lie generally directly adjacent the face 18*d* of the curtain 18. By virtue of training the strap members 46*a* and 46*b* in supportive relationship under the windbar 42, as the curtain closure member 18 is rolled onto the drum 12, the windbar ascends between the guide assemblies 28 and 30 toward the drum at a rate twice the rate of the bottom bar 22 and the lower edge of closure member 18. If the windbar 42 is positioned at substantially the midway point between the drum 12 and the bottom edge 22*a* of the bottom bar 22, when the door curtain closure member 18 is in a closed position with the bottom bar in engagement with a floor surface 11, the windbar 42 will move to a position directly below the drum 12 as the bottom bar 22 moves upward to an open limit position of the door assembly 10.

In order to provide improved windload protection for the curtain 18 to minimize deflection thereof, a second elongated cylindrical tubular windbar 54 is provided for the door assembly 10 and includes opposed ends 54*a* and 54*b* which are also adapted to be disposed in the channel spaces 36*c* and 38*c* of the guide assemblies 28 and 30 for guidance therealong. The windbar 54 is also supported by elongated flexible straps 58 and 60 which may be formed as a single strap member or as opposed separate strap members, as shown in FIG. 1. The straps 58 and 60 are secured at their respective ends 58*a* and 60*a* to a support member 62 comprising an elongated tubular sleeve which is disposed in sleeved relationship over the windbar 42 and is rotatable relative to the windbar 42. The straps 58 and 60 diverge in a somewhat "V" configuration, are trained around and support windbar 54 and lie adjacent curtain face 18*d* also. The opposite ends of the straps 58 and 60 are also secured to the drum 12, respectively, in a suitable manner as will be described in further detail herein.

The second windbar 54 is preferably spaced at a point about midway between the windbar 42 and the curtain bottom bar 22 when the curtain closure member 18 is in a door closed position, usually with the bottom bar 22 in contact with floor surface 11. However, thanks to the arrangement of the support straps 58 and 60 being secured to the drum 12 at their ends opposite the ends 58*a* and 60*a,* when the drum is rotated to raise the curtain closure member 18, the takeup of the straps 58 and 60 will be such that the windbar 54 will move upward toward the drum 12 at a rate 1.50 times the rate of movement of the windbar 42, thanks also to the point of attachment of the strap members 58 and 60 at the sleeve 62. In this way, the windbar 54 will reach a point directly below the windbar 42 when the curtain closure member 18 is rolled onto the drum 12 to the door full open position. The tandem windbar system provided by the windbars 42 and 54 is particularly advantageous for providing more than one windbar suitably positioned, when the flexible curtain closure member 18 is in a closed position, to provide additional support for and resistance to deflection of the curtain.

Figure 3:
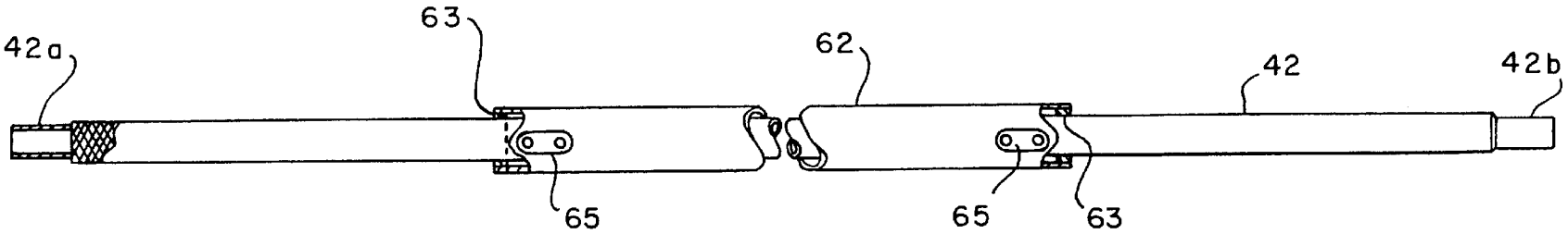
FIG. 3 is a side elevation showing the centrally disposed first or upper windbar and the rotatable sleeve member for supporting the straps for the lower or second windbar.

Referring briefly to FIG. 3, there is illustrated a preferred construction for the windbar 42 and sleeve support member 62 wherein the windbar 42 may be a lightweight metal tubular member having sufficient diameter to provide the requisite stiffness in use. Opposed reduced diameter tubular end parts 42*a* and 42*b* may be separately fabricated, preferably of UHMW Polyethylene, for example. End parts 42*a* and 42*b* are also preferably secured to the windbar 42 by a suitable adhesive or by conventional fasteners, not shown. The tubular sleeve support member 62 is shown disposed on the windbar 42 and is supported thereon by opposed ring-like bearing bushings 63 which are suitably secured in opposite ends of the member 62 and are preferably formed of a suitable self-lubricating polymer material, such as polytetrafluorethylene. Removable plate-like clamps 65 are suitably secured to the tube 62 by conventional mechanical fasteners and are adapted for securing the ends 58*a* and 60*a* of the straps 58 and 60 to the member 62.

Figure 4:
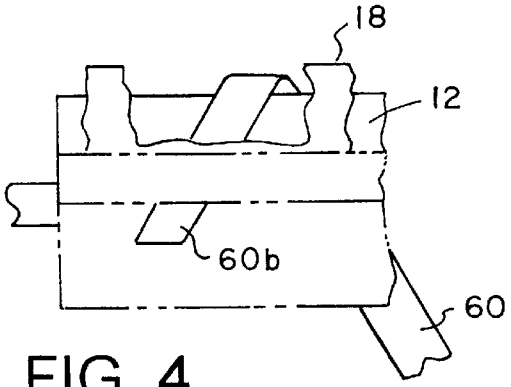
FIG. 4 is a detail view showing one point of attachment of a support strap for the lower windbar to the curtain roller or drum.

Referring briefly to FIG. 4, there is illustrated a detail view, partially broken away showing the drum 12 and the distal end 60*b* of strap 60 secured thereto and under the curtain closure member 18. Strap 58 is similarly secured to drum 12 at its end opposite end 58*a*.

Figure 2:
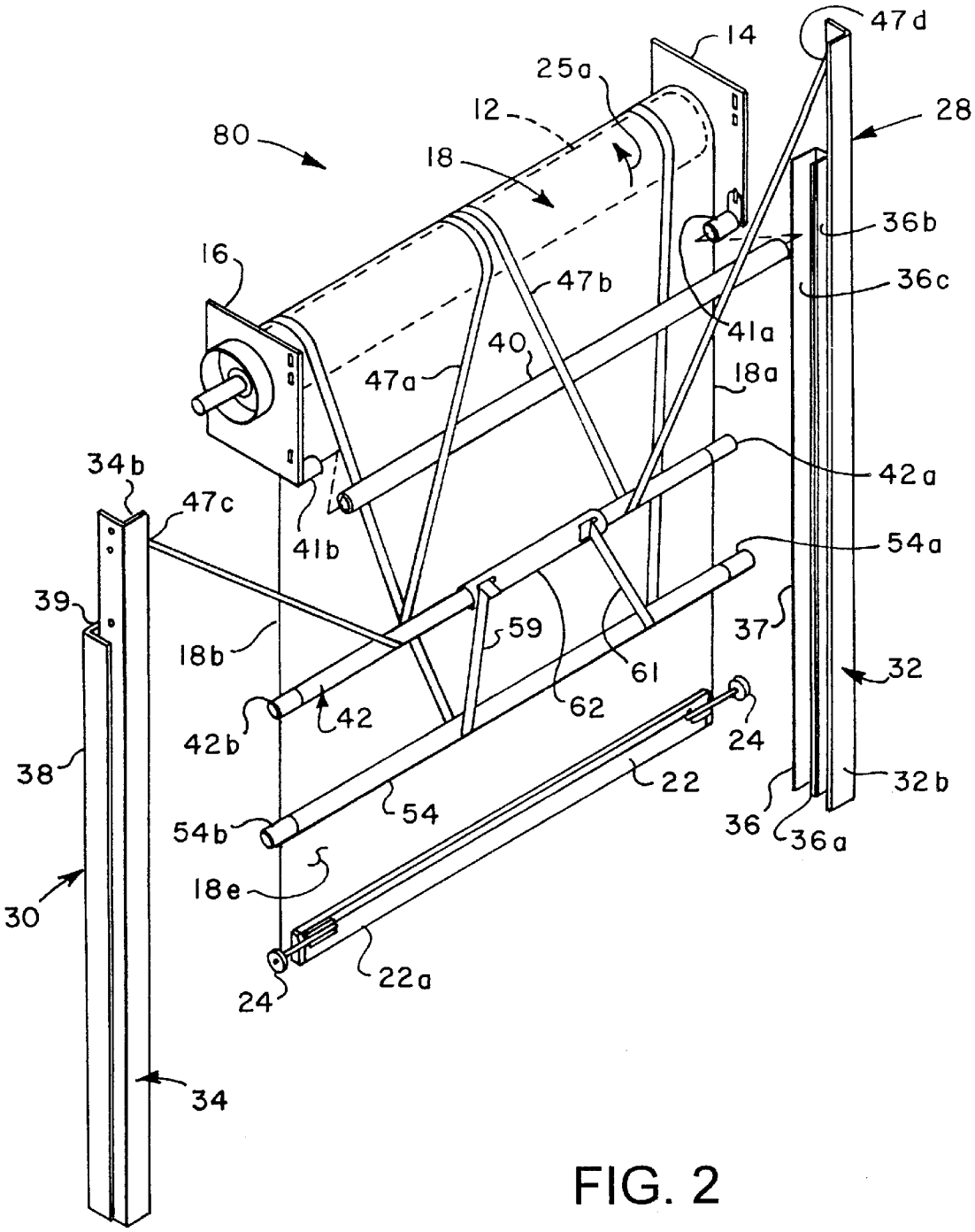
FIG. 2 is an exploded perspective view of a flexible curtain rollup door assembly including a tandem windbar system in accordance with an alternate embodiment of the invention.
Figure 5:
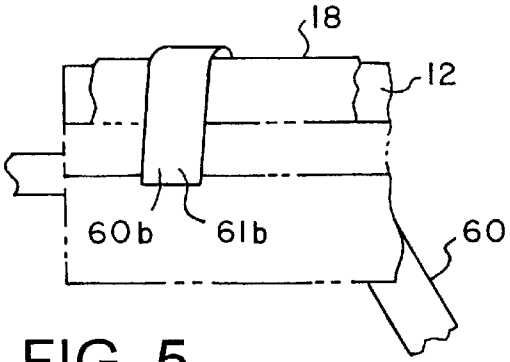
FIG. 5 is a detail view similar to FIG. 4 showing another form of attachment of a support strap for the lower windbar.

Referring briefly to FIG. 5, in an alternate arrangement, the strap 60 (as well as strap 58) is trained over the closure member 18 and end 60*b* is secured to the drum 12 at 61*b* and over the outer facing surface of the curtain closure member for application in accordance with the embodiment illustrated in FIG. 2 of the drawings.

Referring now to FIG. 2, a flexible curtain rollup door assembly 80 is illustrated including a flexible curtain closure member 18 adapted to be rolled onto and off of a rotatable drum 12 supported on and between opposed headplates 14 and 16. Curtain closure member 18 is provided with a bottom bar 22 in the same manner as the curtain for the door assembly 10. A difference between the door assemblies 10 and 80 is the arrangement of the tandem windbars 42 and 54 which are disposed adjacent face 18*e* of the curtain closure member 18. In the arrangement of the closure member 18 for the door assembly 80, the guide bar 40 is adapted to be supported on trunnions 41*a* and 41*b* on the headplates 14 and 16 on the other side of the curtain closure member 18 and operable to engage the face 18*e* of the curtain closure member to train same in such a way that the opposed bottom bar guides 24 are disposed within channel spaces 36*b* and 38*b* formed between the opposed guide members 36 and 38 and the flanges 32*b* and 34*b*, respectively, see FIG. 1A also. The side edges 18*a* and 18*b* of curtain closure member 18 are disposed in slots 36*a* and 38*a* in the same manner as the embodiment of FIG. 1. Closure member 18 rolls onto drum 12 in the direction of arrow 25*a*, FIG. 2, to "open" the door assembly 80.

Accordingly, the windbars 42 and 54 are retained for movement within the channel spaces 36*b* and 38*b* also. Those skilled in the art will recognize that the elongated side edge guide spaces formed by the members 32, 36 and 34, 38 may have other specific configurations. What is normally required, of course, is guide spaces for the guide members 24 and the side edges 18*a* and 18*b* of the closure member 18 as well as guide spaces for the opposed ends 42*a*, 42*b* and 54*a*, 54*b* of the respective windbars 42 and 54.

In the arrangement illustrated in FIG. 2, support strap 47, including strap members 47*a* and 47*b*, is secured to the drum 12 in a manner similar to strap 46 and strap members 47*a* and 47*b* are adjacent to and trained over the face 18*e* of the curtain closure member 18. Straps 47*a* and 47*b* are trained under the windbar 42 and are secured at their opposite ends 47*c* and 47*d* to the guide flanges 34*b* and 32*b*, respectively, as illustrated. Flexible straps 47*a* and 47*b* are preferably trained over the guide bar 40 rather than between the guide bar and the curtain 18. In like manner, flexible straps 59 and 61 are secured to the support member 62 for the door assembly 80 in the same manner that the guide straps 58 and 60 are secured to member 62 for door assembly 10. Support straps 59 and 61 are trained under the windbar 54, diverge toward the opposite side edges of curtain closure member 18, respectively, and lie closely adjacent curtain face 18*e*. Straps 59 and 61 are trained over the drum 12 on the outer face 18*e* of the curtain 18 and are suitably secured, by way of example, to the drum 12 at their distal ends in the manner as shown in FIG. 5 for strap 60.

The operation of the door assembly 80 is substantially like that of the door assembly 10 previously described. The windbars 42 and 54 move between their retracted and extended working positions in the same manner as described above when the curtain closure member 18 is wound onto and off of the drum 12.

It will also be appreciated from the foregoing that the placement of the straps 46, 47, 58, 59, 60 and 61 is such that the portions of the straps extending between the drum 12 and the respective windbars 42 and 54 are operable to provide additional support to minimize deflection of the curtain closure member 18 at points between the windbars and the drum 12.

Those skilled in the art will also recognize that the tandem windbar assemblies for the doors 10 and 80 may be used together for a single door to minimize door curtain deflection under air pressure differentials or windloads which may occur in both directions. The side edge guide assemblies 28 and 30 may or may not require modification to provide channel spaces for the respective ends of each of the windbars of a set of windbars with centered closure member guide channel spaces interposed the guide spaces for the respective sets of windbars for receiving the guide members 24 and the side edges 18*a* and 18*b* of the curtain 18.

The tandem windbar systems associated with the door assemblies 10 and 80 may be fabricated using conventional engineering materials, such as lightweight metals for the windbars 42, 54 and the support member 62. The flexible straps which support the respective windbars may be fabricated of conventional strapping material such as woven polymers, including Nylon or the like.

Although improved windbar systems for flexible curtain rollup type doors have been described in detail hereinabove, those skilled in the art will recognize that various substitutions and modifications may be made to the invention without departing from the scope and spirit of the appended claims.

What is claimed is:

1. In a rollup door for forming a barrier across a doorway, a flexible curtain closure member, elongated winding means for rolling said closure member onto and off of said winding means for opening and closing said door, opposed side edge guide means extending generally along the path of movement of said closure member between open and closed positions, a first elongated windbar extending between said guide means, first flexible strap means supporting said first windbar and operable for raising and lowering said first windbar in response to rolling said closure member onto and off of said winding means and a second elongated windbar operably connected to said first windbar and moveable with said first windbar between extended and retracted positions to position said second windbar between said first windbar and a lower transverse edge of said closure member in a closed position of said door and means for interconnecting said second windbar with said first windbar and said winding means for moving said second windbar between said positions at a rate greater than and in response to movement of said first windbar.

2. The invention set forth in claim 1 wherein:

said second windbar is supported by elongated second flexible strap means, said second strap means being operably connected at one end to said first windbar, trained in supportive relationship around said second windbar and operably connected to said winding means for being rolled onto and off of said winding means in response to rotation thereof.

3. The invention set forth in claim 2 wherein:

said first windbar supports a member thereon, said member supported on said first windbar being connected to said second strap means for supporting said second windbar.

4. The invention set forth in claim 3 wherein:

said member supported on said first windbar comprises a tubular member supported for rotation relative to said first windbar when said closure member is being moved between open and closed positions.

5. The invention set forth in claim 4 wherein:

said tubular member is supported on bearing bushings engageable with and rotatable relative to said first windbar.

6. The invention set forth in claim 2 wherein:

said second flexible strap means comprises a pair of elongated flexible strap members operably connected at one end, respectively, to said first windbar and diverging from each other between said second windbar and said winding means and lying closely adjacent to a face of said closure member in supportive relationship thereto.

7. The invention set forth in claim 6 wherein:

said strap members of said second strap means lie adjacent to and are engageable with an inner face of said closure member.

8. The invention set forth in claim 6 wherein:

said strap members of said second strap means lie adjacent to and are engageable with an outer face of said closure member.

9. The invention set forth in claim 1 wherein:

said first flexible strap means supporting said first windbar comprises a continuous elongated flexible strap secured at, substantially, a midpoint thereof to said winding means and forming opposed strap members depending to and supporting said first windbar and extending to stationary support means.

10. The invention set forth in claim 9 wherein:

said strap members of said first flexible strap means diverge from said winding means and extend along and are engageable with a face of said closure member between said winding means and said first windbar, respectively.

11. The invention set forth in claim 10 wherein:

said strap members of said first strap means are secured to said winding means and lie adjacent an inner face of said closure member.

12. The invention set forth in claim 10 wherein:

said strap members of said first strap means are secured to said winding means to lie adjacent an outer face of said closure member.

13. In a rollup door for forming a barrier across a doorway, a flexible curtain closure member, elongated winding means for rolling said closure member onto and off of said winding means for opening and closing said door, opposed side edge guide means extending generally along the path of movement of said closure member between open and closed positions, a first elongated windbar extending between said guide means, first flexible strap means supporting said first windbar and operable for raising and lowering said first windbar in response to rolling said closure member onto and off of said winding means, a second elongated windbar moveable between a retracted position and a position between said first windbar and a lower transverse edge of said closure member in a closed position of said door, and second strap means comprising a pair of elongated flexible straps connected to said second windbar and operably connected at one end, respectively, to said first windbar, said second strap means being operably connected to said winding means for being rolled onto and off of said winding means in response to rotation thereof.

14. The invention set forth in claim 13 wherein:

said straps of said second strap means diverge from each other between said second windbar and said winding means and are disposed closely adjacent to a face of said closure member in supportive relationship thereto.

15. The invention set forth in claim 13 wherein:

said straps of said second strap means lie adjacent to and are engageable with an inner face of said closure member.

16. The invention set forth in claim 13 wherein:

said straps of said second strap means lie adjacent to and are engageable with an outer face of said closure member.

17. In a rollup door for forming a barrier across a doorway, a flexible curtain closure member, elongated winding means for rolling said closure member onto and off of said winding means for opening and closing said door, opposed side edge guide means extending generally along the path of movement of said closure member between open and closed positions, a first elongated windbar extending between said guide means and moveable between working and retracted positions in response to closing and opening said closure member, a second elongated windbar operably connected to said first windbar and moveable with said first windbar between working and retracted positions to position said second windbar between said first windbar and a lower transverse edge of said closure member in a closed position of said door and at least one member interconnecting said second windbar with said first windbar for moving said second windbar between said positions at a rate greater than and in response to movement of said first windbar.

18. In a rollup door for forming a barrier across a doorway, a flexible curtain closure member, elongated winding means for rolling said closure member onto and off of said winding means for opening and closing said door, opposed side edge guide means extending generally along the path of movement of said closure member between open and closed positions, a first elongated windbar extending between said guide means and moveable between working and retracted positions in response to closing and opening said closure member and a second elongated windbar operably connected to said first windbar and moveable with said first windbar between working and retracted positions to position said second windbar between said first windbar and a lower transverse edge of said closure member in a closed position of said door, said windbars are supported by elongated first and second flexible strap means, respectively, said first strap means being operably connected to said first windbar and said winding means and said second strap means being operably connected at one end to said first windbar, trained in supportive relationship around said second windbar and operably connected to said winding means for being rolled onto and off of said winding means in response to rotation thereof.

19. The invention set forth in claim 18 wherein:

said first windbar supports a member thereon, said member supported on said first windbar being connected to said second strap means for supporting said second windbar.

20. In a rollup door for forming a barrier across a doorway, a flexible curtain closure member, elongated winding means for rolling said closure member onto and off of said winding means for opening and closing said door, opposed side edge guide means extending generally along the path of movement of said closure member between open and closed positions, a first elongated windbar extending between said guide means, first flexible strap means supporting said first windbar and secured to said winding means and forming opposed strap members depending to and supporting said first windbar, said opposed strap members extending to stationary support means, respectively, and being operable for raising and lowering said first windbar in response to rolling said closure member onto and off of said winding means, a second elongated windbar, second flexible strap means operably connected at one end to said first windbar, said second strap means being trained around said second windbar and operably connected to said winding means for moving said second windbar with said first windbar between extended and retracted positions to position said second windbar between said first windbar and a lower transverse edge of said closure member in a closed position of said door.

* * * * *